US006666188B2

(12) United States Patent
Knoedl et al.

(10) Patent No.: US 6,666,188 B2
(45) Date of Patent: Dec. 23, 2003

(54) FUEL HIGH PRESSURE ACCUMULATOR FOR FUEL INJECTION SYSTEM OF INTERNAL COMBUSTION ENGINES

(75) Inventors: Helmut Knoedl, Marbach-Rielingshausen (DE); Steffen Jung, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/991,858

(22) Filed: Nov. 14, 2001

(65) Prior Publication Data

US 2002/0112697 A1 Aug. 22, 2002

(30) Foreign Application Priority Data

Nov. 14, 2000 (DE) ..... 100 56 405

(51) Int. Cl.[7] ..... F02M 37/04
(52) U.S. Cl. ..... 123/456; 123/468

(58) Field of Search ..... 123/456, 468, 123/469, 470

(56) References Cited

U.S. PATENT DOCUMENTS 6,126,208 A * 10/2000 Asada et al. ..... 123/468
6,213,095 B1 * 4/2001 Asada et al. ..... 123/456
6,263,862 B1 * 7/2001 Asada et al. ..... 123/456
6,470,856 B1 * 10/2002 Boecking ..... 123/456

FOREIGN PATENT DOCUMENTS

DE 196 40 480 A1 4/1998

* cited by examiner

*Primary Examiner*—Thomas N. Moulis
(74) *Attorney, Agent, or Firm*—Michael J. Striker

(57) ABSTRACT

In a fuel high pressure accumulator for fuel injection devices an intersecting region between a storage chamber and a connection opening of a connection pipe, as well as a region of an outer wall which is opposite to the connecting region are designed to improve pressure strength.

11 Claims, 3 Drawing Sheets

FUEL HIGH PRESSURE ACCUMULATOR FOR FUEL INJECTION SYSTEM OF INTERNAL COMBUSTION ENGINES

BACKGROUND OF THE INVENTION

The present invention relates to a fuel high pressure accumulator for a fuel injection system of an internal combustion engine, with a storage chamber and at least one connection pipe.

In such fuel high pressure accumulators, in the region of the intersection of the storage chamber inner wall and the opening which connects the storage chamber and the connecting pipe, stress peaks occur. There is therefore a danger that the fuel high pressure accumulator in this region can break, in particular since the storage chamber is subjected to dynamic pressure loads. In order to reduce the risk of breakage, various constraints have been provided. Therefore the pressure strength of the inventive fuel high pressure accumulator, in particular in the case of dynamic pressure loads, is increased.

One of the corresponding possibilities resides in increasing the wall thickness of the fuel high pressure accumulator. However the wall thickness of the fuel high pressure accumulator has certain limits since the thicked-walled body in condition of high dynamic pressure loads forms cracks, in particular in the region of wall openings and sharp-edged cross-sectional changes.

German patent document DE 196 40 480 A1 discloses a cylindrical fuel high pressure accumulator, in which the longitudinal axis of the opening which connects the storage chamber and the connection pipe is a secant of the circular storage chamber cross-section. Thereby a reduction of the stresses in the region of the intersection of the storage inner wall and the opening is achieved, so that the loading capacity and service life of the fuel high pressure accumulator are increased.

SUMMARY OF THE INVENTION

Accordingly, it is an object of the present invention to provide a fuel high pressure accumulator which avoids the disadvantages of the prior art.

More particularly, it is an object of the present invention to provide the fuel high pressure accumulator with increased strength, in particular in condition of dynamic pressure loads.

In keeping with these objects and with others which will become apparent hereinafter, one feature of present invention resides, briefly stated, in a fuel high pressure accumulator for a fuel injection system of an internal combustion engines, which has a storage chamber limited by an inner wall, and at least one connecting pipe, wherein the connecting pipe has at least one connecting opening which opens into the storage chamber, and the inner wall in an intersecting region of the inner wall and the connecting opening is substantially flat.

When the fuel high pressure accumulator is designed in accordance with the present invention with the inner wall specifically designed in the intersection region with a connecting opening, then with the deformation of the fuel high pressure accumulator under pressure, pressure stresses are induced in the intersection region which, equalize a part of pulling stresses and stress picks resulting in the intersection region from the inner pressure, so that the pressure strength of the inventive fuel high pressure accumulater is increased.

The inner wall in the intersection region can be slightly concave or convex. The inventive advantages are also achieved with this curvature, so that in connection with the inventive feature of being substantially flat, a slightly concave or slightly convex curvature also falls under this feature.

In accordance with the present invention the storage chamber can be prismatic, so that it can be easily produced. For example, with corresponding spaces, the desired inner control of the fuel high pressure accumulator can be produced.

In accordance with a further embodiment of the present invention, the storage chamber can be ball-shaped. Therefore, regardless of the intersection regions with the connecting openings, a uniform stress condition in the fuel high pressure accumulator is provided.

In accordance with another embodiment of the present invention, the same advantages are achieved in a fuel high pressure accumulator for a fuel injection system of internal combustion engines having an outer wall, a storage chamber limited by an inner wall and at least one connecting pipe, wherein the connecting pipe has at least one connecting opening which opens into the storage chamber and the wall thickness of the fuel high pressure accumulator at least in the intersecting region of the inner wall and the connecting opening reduces and wherein the wall thickness of the fuel high pressure accumulator reduces in a region which is substantially opposite to the intersecting region of the inner wall and the connecting opening.

In this embodiment, the region of the fuel high pressure chamber which is opposite to the intersecting region deviates under pressure from outside outwardly, so as to also induce pressure stresses in the intersecting region. As a result, also the pulling stresses and stress peaks in the intersecting region of the fuel high pressure accumulator under pressure are reduced, so that its pressure strength is further increased.

The reduction of the wall thickness can be performed so that, the fuel high pressure accumulator at least in the region which is opposite to the intersecting region of the inner wall and the connecting opening has a transverse opening which extends substantially perpendicular to the longitudinal axis of the storage chamber and the connection opening. The reduction of the wall thickness can be performed in a simple manner in the already known fuel high pressure accumulator.

In accordance with another embodiment of the present invention, the outer wall at least in a region which is substantially opposite to the intersecting region of the inner wall and the connecting opening is flattened, so that the reduction of the wall thickness can be produced in a simple manner, for example by milling and leads to low stress peaks in the region of the reduced wall thickness. For further improvement or the stress condition in the fuel high pressure accumulator, it is provided that the flattening is flat or curved concavely or convexly and/or a chamfer or a rounding is provided in the outer wall.

The pressure strength of an inventive fuel high pressure accumulator is further increased, when the inner wall in an intersecting region is substantially flat while the storage chamber is prismatic or spherical, and the outer wall is provided with a transverse opening in an opposite region substantially perpendicular to a longitudinal axis of the storage chamber and can be flat, concave, convex and also provided with a chamfer or a rounding.

The manufacture of the inventive fuel high pressure accumulator can be simplified when it is assembled of a pipe with welded connecting pipes.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
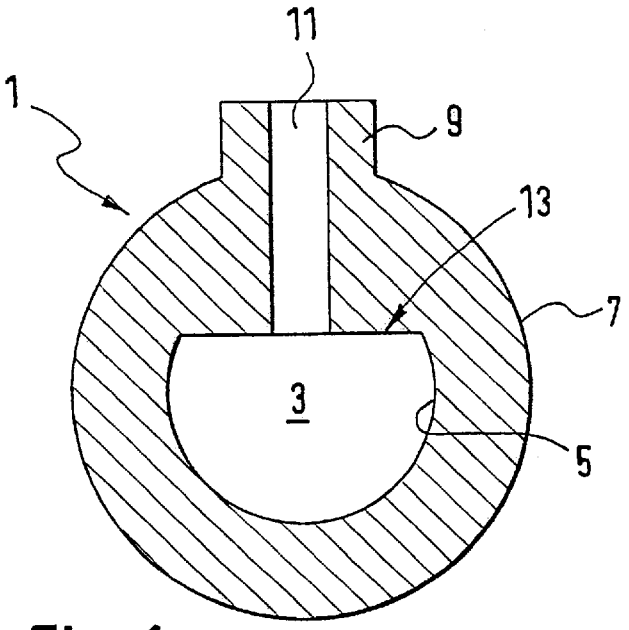
FIGS. 1–2 are views showing a fuel high pressure accumulator with an inner wall design in accordance with one embodiment of the present invention.

A fuel high pressure accumulator for a fuel injection system of internal combustion engines in accordance with the first embodiment of the invention is shown in a cross-section of FIG. 1. The fuel high pressure accumulator 1 has a storage chamber 3 which is limited by an inner wall 5. An outer wall 7 separates the interior of the fuel high pressure accumulator 1 from a surrounding area. A connecting pipe 9 provided with a connecting opening 11 is used for supplying fuel into the storage chamber 3 or withdrawing fuel from the storage chamber 3. A not shown high pressure line is connected to the connecting pipe 9, which connects the fuel high pressure accumulator 1 for example with a not shown injector.

The inner wall 5 is formed flat in an intersecting region 13 between the connecting opening 11 and the inner wall 5. With FEM calculations it can be determined that when a pressure acts in the storage chamber 3, because of the flat inner wall 5 in the intersection region 13, pressure stresses are induced in this region, which are partially equalized by the pulling stresses caused by the inner pressure in the intersection region 13. Thereby the pressure strength of the fuel high pressure accumulator 1, in particular in condition of dynamic pressure loads, is improved. When the storage chamber 3 has a prismatic shape, the storage chamber 3 can be produced for example by broaching in a relatively cost-favorable manner.

Figure 2:
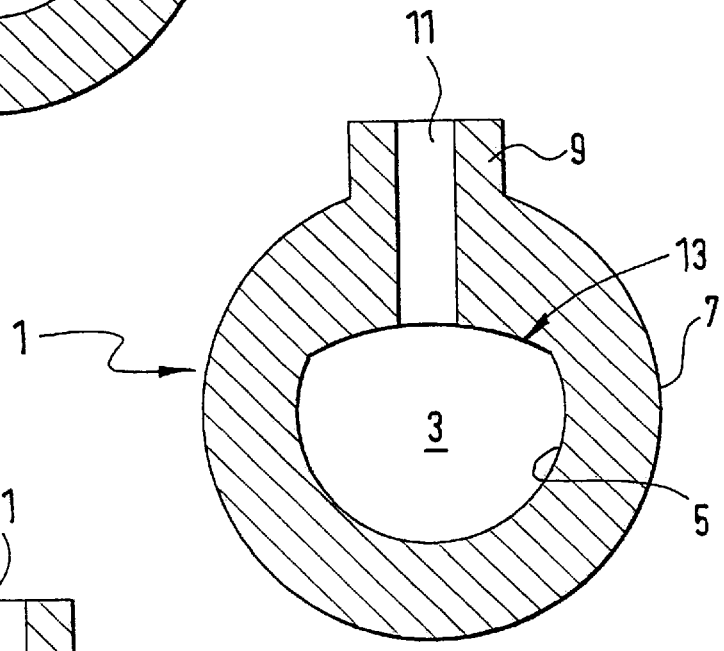
Figure 3:
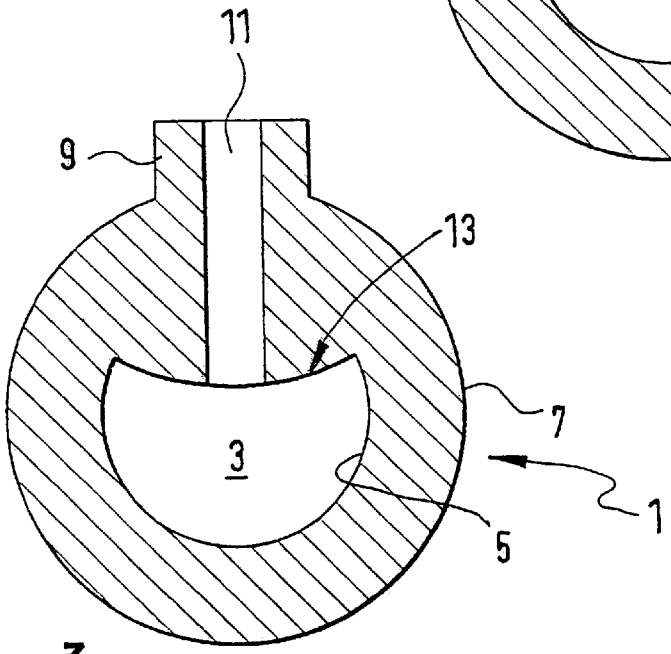

In the embodiment shown in FIG. 2, the intersecting region 13 is slightly concave. In the embodiment of FIG. 3, the intersecting region 13 is slightly convex. With FEM calculations it can be determined that also in this embodiment the pressure strength of the fuel high pressure accumulator 1 is improved. In connection with this aspect of the invention, the intersecting region 13 of the embodiments of FIGS. 2 and 3 is formed substantially flat.

Figure 4:
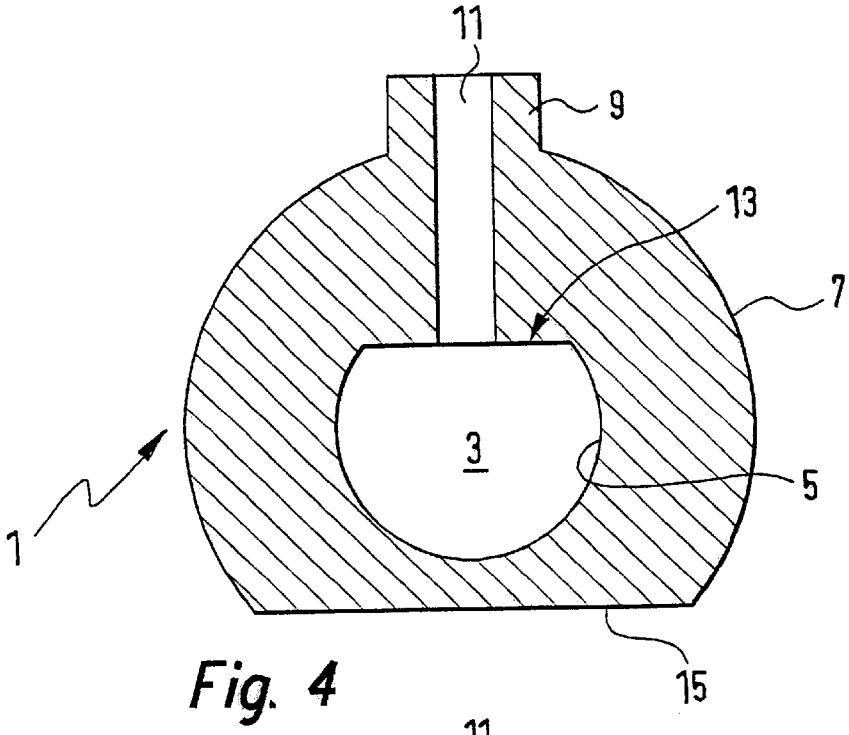
FIGS. 4–9 are views showing a fuel high pressure accumulator with an outer wall in accordance with another embodiment of the present invention.

In the embodiment of FIG. 4, the wall thickness of the fuel pressure accumulator in the region which is opposite to the intersecting region 13 is reduced. This is achieved, in that a flattening 15 is provided on the outer wall 7. When the storage chamber 3 of the inventive fuel high pressure accumulator is loaded with pressure, the region with the reduced wall thickness deviates outwardly, so that the storage chamber 3 has a slightly oval cross-section. This deformation which is not shown in FIG. 4 leads to the situation that pressure stresses are induced in the intersection region 13, which reduce the pulling loads in the intersection region 13 and thereby increase the pressure strength of the fuel high pressure accumulator 1.

Figure 5:
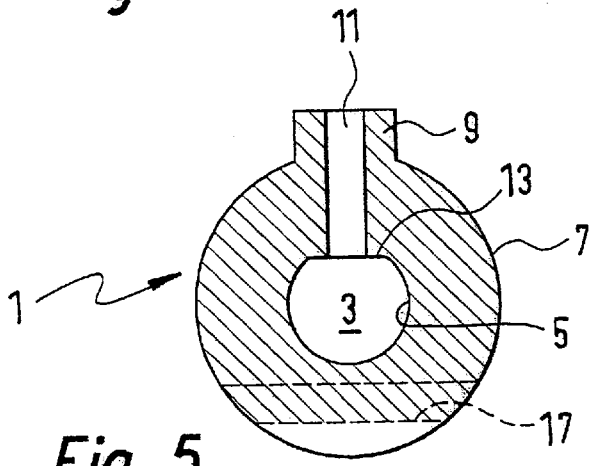

FIG. 5 shows a further embodiment of the present invention, in which the reduction of the wall thickness is achieved by a transverse opening 17. The transverse opening 17 extends substantially perpendicular to the longitudinal axis of the storage chamber 3 and to the connection opening 11. In this embodiment the cross-section of the storage chamber 3 is circular. From this embodiment it is clear that the design of the intersection region 13 in accordance with FIGS. 1–3 and the reduction of the wall thickness in a region which is opposite to the intersection region 13 are independent from one another. Both features increase the pressure strength of the fuel high pressure accumulator 1 and can be used individually and in combination with one another. This is true for all embodiments.

Figure 6:
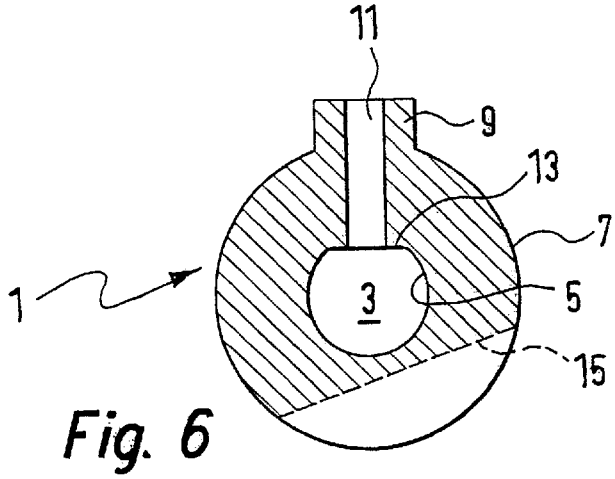

FIG. 6 shows a further embodiment of a fuel high pressure accumulator 1 in accordance with the present invention. In this embodiment the flattening 15 is located exactly opposite to the intersecting region 13. Also in this embodiment the desired increase of the pressure strength can be determined by FEM calculations. This out-of-center arrangement of the flattening 15 can be required due to restrictions for example of the available mounting space. In the embodiment of FIG. 6 the outer wall 17 of the fuel high pressure accumulator 1 is not prismatic, but instead the flattening is available, when considered in a longitudinal direction of the fuel high pressure accumulator 1, where a connecting pipe 9 is provided. The flattening 14 can be formed as a groove or a slot in the outer wall 7.

Figure 7:
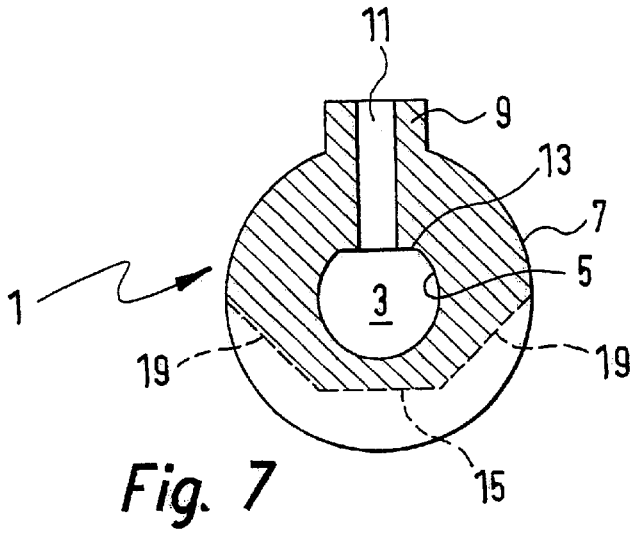

In the embodiment of FIG. 7 a chamfer 19 is provided between the outer wall 7 and both sides of the flattening 15. Because of the chamfer 19, a uniform stress distribution over the periphery of the fuel high pressure accumulator 1 is obtained. Also, in the embodiment of FIG. 7 the flattening 15 together with the chamfer 19 can be formed as a groove in the outer wall 7.

Figure 8:
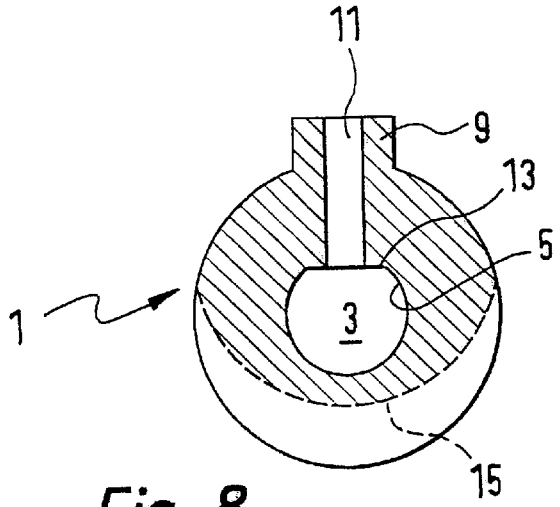

In the embodiment of FIG. 8, the flattening 15 is curved convexly. Therefore a further improvement of the stress condition is provided.

Figure 9:
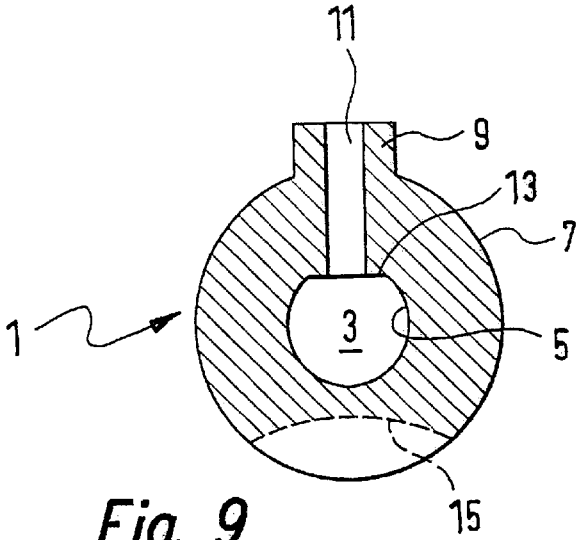

In the embodiment of FIG. 9, the flattening 15 is curved concavely. It can be produced in a simple manner, for example with disc mill of a suitable diameter with a corresponding adjustment movement. In this embodiment also the desired effect is achieved in that, by the deformation of the fuel high pressure accumulator 1 in the region of the flattening 15, pressure stresses in the intersection region 13 are reduced.

The inventive design of a pressure-loaded component with an opening intersection with a flattening on the inner wall and/or the outer wall can be transferred to other components, such as an injectors, pump nozzle bodies, etc.

All features which are shown in the drawings and explained in the specification as well as claimed in the claims can be used in any combination with one another.

It will be understood that each of the elements described above, or two or more together, may also find a useful application in other types of constructions differing from the types described above.

While the invention has been illustrated and described as embodied in fuel high pressure accumulator for fuel injection system for internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A fuel high pressure accumulator for a fuel injection system of internal combustion engines, comprising an outer wall; an inner wall which limits a storage chamber; at least one connecting pipe provided with at least one connecting opening which opens into said storage chamber, a wall thickness between said inner wall and said outer wall in a region which is substantially opposite to an intersecting region between said inner wall and said connecting opening being reduced relative to a remaining region.

2. A fuel high pressure accumulator as defined in claim 1, wherein said outer wall at least in said region which is substantially opposite to an intersecting region between said inner wall and said connecting opening has a transverse opening which extends substantially perpendicular to a longitudinal axis of said storage chamber and said connecting opening.

3. A fuel high pressure accumulator as defined in claim 1, wherein said outer wall in said region which is substantially opposite to an intersecting region of said inner wall and said connecting opening is flattened.

4. A fuel high pressure accumulator as defined in claim 3, wherein said flattening has a shape selected from the group consisting of a flat shape, a concave shape, and a convex shape.

5. A fuel high pressure accumulator as defined in claim 3; and further comprising a formation provided between said flattening and said outer wall and selected from the group consisting of a chamfer and a rounding.

6. A fuel high pressure accumulator as defined in claim 1, wherein said inner wall in said intersecting region between said inner wall and said connecting opening is substantially flat.

7. A fuel high pressure accumulator as defined in claim 1, wherein said storage chamber is prismatic.

8. A fuel high pressure accumulator as defined in claim 1, wherein said storage chamber is spherical.

9. A fuel high pressure accumulator as defined in claim 1, wherein said outer wall has a prismatic outer contour.

10. A fuel high pressure accumulator as defined in claim 1, wherein said storage chamber is formed as a pipe with said connecting pipe welded to it.

11. An inwardly pressure loaded component, comprising an inner chamber limited by an inner wall; an outer wall; an at least one connecting opening which opens into said inner chamber, said inner wall in an intersecting region between said inner wall and said connecting opening being substantially flat, and a wall thickness of the component at least in a region which is substantially opposite to said intersecting region is reduced relative to a remaining region.

* * * * *